United States Patent [19]

Shaff

[11] Patent Number: 4,682,470

[45] Date of Patent: Jul. 28, 1987

[54] CATALYTIC CONVERTER FOR EXHAUST GASES

[75] Inventor: Gerald Shaff, Chelsea, Mich.

[73] Assignee: Echlin, Inc., Branford, Conn.

[21] Appl. No.: 825,202

[22] Filed: Feb. 3, 1986

Related U.S. Application Data

[63] Continuation of Ser. No. 601,249, Apr. 17, 1984, abandoned.

[51] Int. Cl.[4] ..... F01N 3/28

[52] U.S. Cl. ..... 60/299; 181/239; 181/256; 422/179; 422/181

[58] Field of Search ..... 60/299; 181/238, 239, 181/256; 422/179, 181

[56] References Cited

U.S. PATENT DOCUMENTS

| | | | |
|---|---|---|---|
| 3,094,394 | 6/1963 | Innes | 422/181 |
| 3,406,515 | 10/1968 | Behrens | 60/288 |
| 3,916,057 | 10/1975 | Hatch | 422/179 |
| 3,920,404 | 11/1975 | Gandhi | 422/181 |
| 4,192,402 | 3/1980 | Nakagawa | 181/256 |
| 4,208,374 | 6/1980 | Foster | 422/181 |
| 4,290,501 | 9/1981 | Tanaka | 181/256 |

FOREIGN PATENT DOCUMENTS

| | | | |
|---|---|---|---|
| 2123532 | 11/1972 | Fed. Rep. of Germany | 422/177 |
| 1443886 | 5/1966 | France | 60/297 |
| 11183 | 4/1972 | Japan | 181/239 |
| 428257 | 5/1935 | United Kingdom | 181/239 |

*Primary Examiner*—Douglas Hart

*Attorney, Agent, or Firm*—Wolf, Greenfield & Sacks

[57] ABSTRACT

An internal combustion engine exhaust gas catalytic converter has coaxial inner and outer louvered tubes which define an annular catalyst bed. An outer shell coaxial with the inner and outer louvered tubes define a portion of a gas flow path downstream from the catalytic bed. The downstream flow portion has an annular outlet of smaller cross sectional area than the cross-sectional area of the inlet end of an upstream portion of the flow path. Heat expandable means maintain a constant density of catalyst beads within the catalytic bed. These heat expandable means preferably comprise a composition of ceramic fibers, vermiculite and a binder.

5 Claims, 7 Drawing Figures

CATALYTIC CONVERTER FOR EXHAUST GASES

This application is a continuation, of application Ser. No. 06/601,249, filed Apr. 17, 1984 and now abandoned.

SUBJECT MATTER OF INVENTION

The present invention relates to an improved catalytic converter for exhaust gases designed especially for use with automotive engines.

BACKGROUND OF INVENTION

There have been a variety of catalytic converters designed for automobile exhaust systems. These converters have included some in which catalyst beads are arranged in an annular bed within the converter to intercept the flow of gas from the engine to the automobile muffler. Some of these converters include designs in which an upstream portion of the exhaust gas first flows into the converter within the annular catalytic bed, then radially through the catalytic bed and finally into a downstream annular flow path outward of the coaxial bed. Such converters are illustrated in U.S. Pat. No. 3,824,790 issued July 23, 1974 in the name of Thomaides, U.S. Pat. No. 3,449,086 issued June 10, 1969 in the name of Innes, U.S. Pat. No. 3,094,393 issued June 16, 1963 in the name of Innes, U.S. Pat. No. 4,208,374 issued June 17, 1980 in the name of Foster, U.S. Pat. No. 3,966,443 issued June 29, 1976 in the name of Okano et al and U.S. Pat. No. 4,148,860 issued Apr. 10, 1979 in the name of Goedicke.

While these patents all appear to provide catalytic converters which reduce harmful substances in the exhaust stream, including unburned hydrocarbons, carbon monoxide and oxides of nitrogen, as well as other components, such designs do have limitations which affect their use. In some of these systems, the catalyst beads abrade during the use of the converter. The abrasion of these catalyst beads significantly reduce the efficiency of the converter over time. The beads abrade because the volume of the catalytic bed expands relative to the volume of the beads when the converter is heated in use. This in turn permits relative movement of the beads as the gas passes through the bed, causing the beads to abrade against one another. Attempts to minimize this abrasion and the consequent attrition of the beads has resulted in efforts to maintain a constant volume in the catalytic bed when the converter is heated. Thus, for example, Innes, U.S. Pat. No. 3,094,394 discloses a relatively elaborate spring mechanism which is intended to maintain a compressive force on the bed as it is heated by the gas flow, thereby maintaining a constant density of the beads in the bed. The Innes reference does not disclose a commercially practical spring mechanism which is capable of withstanding the 1500° F. or more temperature to which these catalytic converters are subjected. In other references inadequate provisions are made for appropriate compensation of the expansion of the volume of the catalytic bed.

In addition, many of these prior art catalytic converters have designs in which noise from the flow of gas is not minimized. Insofar as can be determined, the prior art constructions of the annular outlet in the downstream flow path with cross-sectional areas larger than the cross-sectional area of the inlet end of the upstream portion of the gas flow path. It has been found that in such an arrangement, there is a significant noise level under normal operating conditions generated by gas movement.

SUMMARY OF INVENTION

The present invention is intended to overcome the problems referred to above. Specifically, the present invention provides an improved catalytic converter which comprises an annular catalyst bed that is coaxial with respect to an outer shell. A gas flow path includes an upstream portion within the annular catalyst bed and an annular downstream portion coaxial with and intermediate the catalyst bed and outer shell. An annular outlet constricts the downstream portion to a cross-sectional area that is equal to or less than the cross-sectional area of the upstream portion. In a preferred embodiment, heat expandable means are provided to maintain a constant volume for the beads in the catalyst bed which heat expandable means preferrably comprises a composition of ceramic fibers, vermiculite and a binder.

This construction provides an improved noise control by significantly lowering the noise level caused by the flow of gas through the system. It is theorized that the constriction in the outlet of downstream portion of the flow path causes a damping of the pulses of gases caused in successive engine explosions. This damping of exhaust pulses reduces noise. The reduction of these pulses and noise reduce the extent to which mufflers must be relied upon for noise control.

Additionally, the constriction in the downstream portion of the gas flow path causes a back pressure. This in turn forces the gases into a more even contact with the catalyst beads, thereby improving the efficiency of the converter.

The improved heat expandable means provided is more reliable for maintaining a uniform volume of the catalyst bed. This in turn reduces the extent to which the catalyst beads abrade thereby extending the longevity of the converter.

The present invention is also designed to provide an improved catalytic converter, capable of being manufactured for use with a wide range of automobile engines in which the converter may be simply designed for different size engines by the expedient of changing the dimensions of only the annular outlet.

Thus, it is an object of the present invention to provide an improved catalytic converter which is inexpensive to make, adaptable for use with a wide-range of automobile engines, designed for long life, rugged in construction and efficient in use.

BRIEF DESCRIPTION OF DRAWINGS

The foregoing objects and advantages of the present invention will be more clearly understood when considered in conjunction with the accompanying drawings in which.

DESCRIPTION OF THE PREFERRED EMBODIMENT

Figure 1:
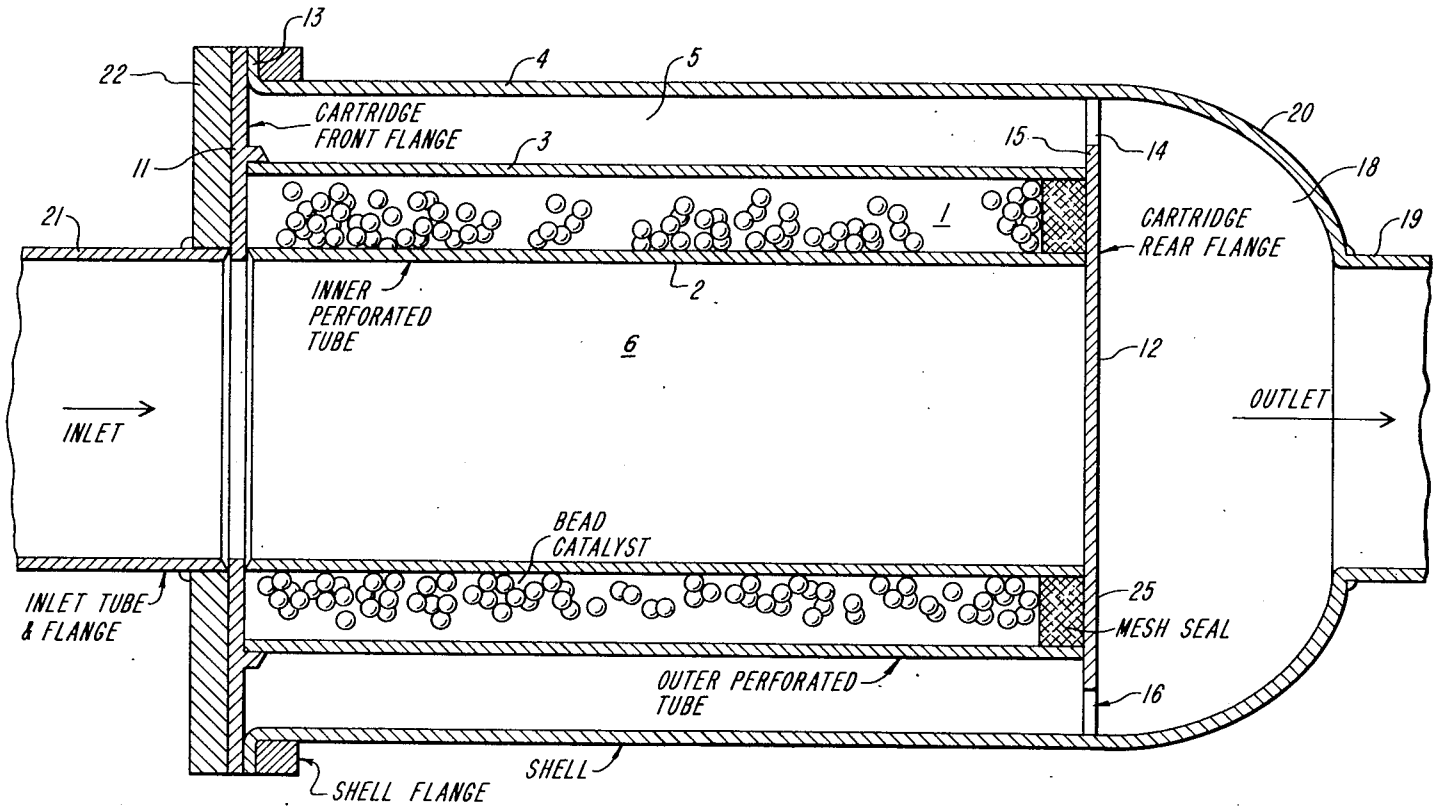
FIG. 1 is a cross-section taken longitudinally of a catalytic converter embodying the invention.

The catalytic converted illustrated in FIG. 1 is formed with an annular catalyst bed 1, defined by an inner louvered tube 2 and spaced coaxial outer louvered tube 3. An outer shell 4 is also coaxial with the annular catalyst bed 1 and defines a downstream portion 5 of the gas flow path. The gas flow path also includes an upstream portion 6 which is on the upstream side of the catalyst bed 1.

Figure 3:
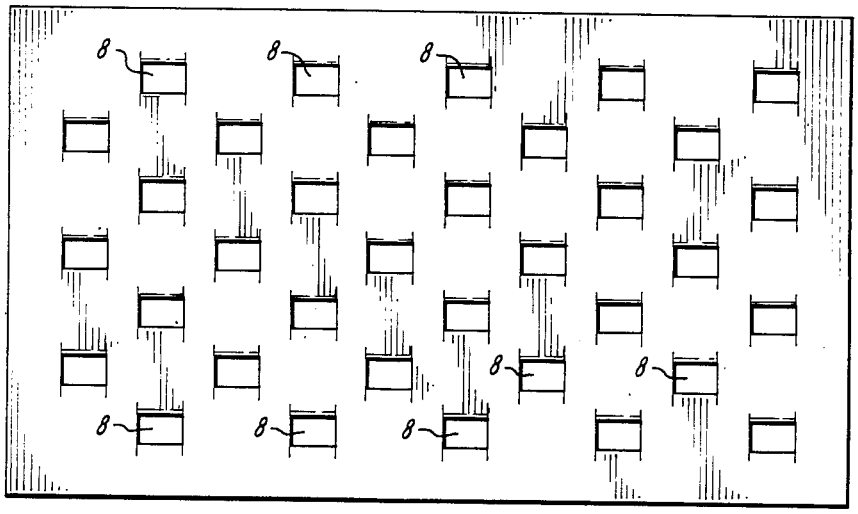
FIG. 3 is a plan view of a sheet of metal from which the inner louvered tube is made.
Figure 5:
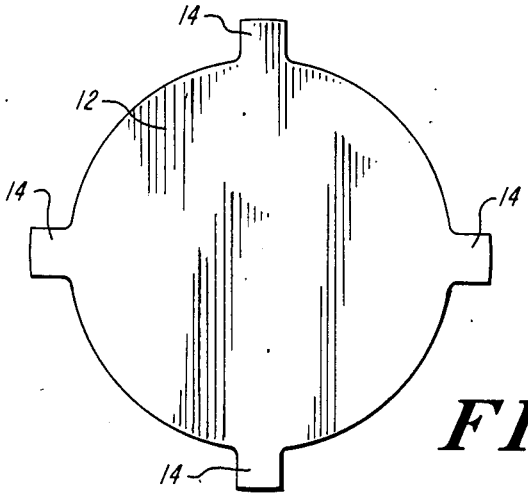
FIG. 5 is a plan view of the cartridge rear flange.
Figure 4:
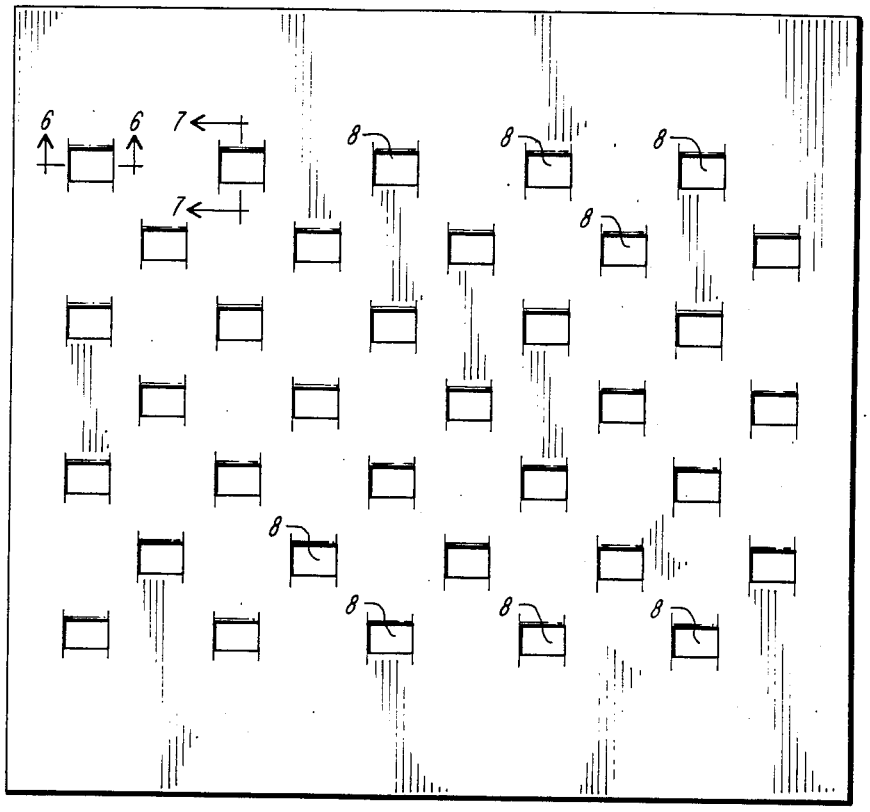
FIG. 4 is a plan view of a sheet of metal from which the outer louvered tube is made.
Figure 6:
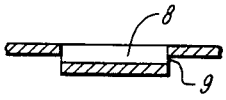
FIG. 6 is a cross-sectional detail taken along the line 6—6 of FIG. 4.
Figure 7:
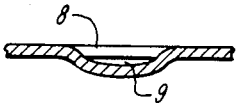
FIG. 7 is a cross-sectional view of a detail taken along line 7—7 of FIG. 4.

The inner and outer louvered tubes are formed of sheets of metal, preferrably a mild steel capable of withstanding the relatively high temperatures to which catalytic converters are subjected. FIGS. 3 and 4 respectively illustrated the sheet from which the inner and outer tubes are formed. The tubes are each provided with louvers or openings 8 illustrated in cross-section at FIG. 6 and 7. The louvers or openings 8 are arranged in rows and columns. Typically, louvers may be spaced longitudinally apart approximately an inch from center line to center line and three-quarters of an inch laterally, center line to center line. Preferrably, as illustrated in FIGS. 6 and 7 the louvers may be formed of depressed segments of metal formed on a radius of one inch with each louvered section approximately three-eighths of an inch in width and one-sixth of an inch in height. The louvers should have openings 9 small enough to prevent the catalyst beads from falling through, but sufficiently large to permit the free flow of gas through the catalyst bed 1 from the upstream portion 6 to the downstream portion 5. The catalyst bed 1 may have an inner diameter of approximately two inches and an outer diameter of approximately three inches. The inner diameter of the outer shell 4 may be approximately four inches. A pair of flanges 11 and 12 close respectively the front and rear ends of the catalyst bed 1. Front flange 11 comprises an annular ring having an inner diameter coincident with the inner diameter of inner louvered tube 2 to which it is welded. Outer louvered tube 3 is also welded to flange 11 intermediate its inner and outer peripheries. Rear flange 12 is illustrated in planar view in FIG. 5 and consists essentially of a disk like member having a radius of approximately three and a half inches. This radius projects radially beyond the outer periphery of outer louvered tube 3 to which it is welded. Four tabs or dogs 14 radially arranged at 90 degrees with respect to one another are integrally formed on the rear flange 12 and provide spacers that engage and position the plate within the outer shell 4.

The annular lip 15 formed by the projecting portion of the rear flange 12 provides a constriction in the downstream portion 5 of the gas flow path and constitutes an annular outlet 16 that is smaller in cross-sectional area than the cross-sectional area of the upstream portion 6 of the gas flow path.

The outer shell 4 preferrably formed of a 409 stainless steel extends rearwardly beyond the outlet 16 of the downstream portion of the flow path and is connected to an outlet tube 19 by a spherically tapered section 20 that forms a chamber 18. The outlet tube 19 may be suitably connected to a muffler or the like.

Figure 2:
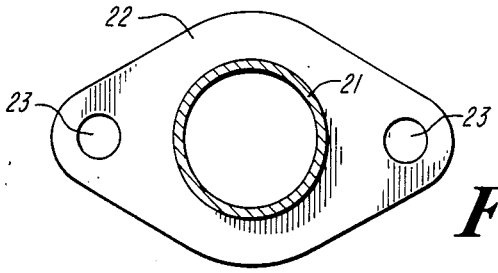
FIG. 2 is an end view (not to scale) looking from the left of FIG. 1.

The cartridge front flange 11 is suitably secured to the exhaust system of an automobile engine between the engine and muffler. A tube 21 from the engine through which exhaust gases pass is provided with a mounting flange 22. A catalytic converter is suitably secured to the mounting flange 22 by suitable means such as bolts 23, best illustrated in FIG. 2.

The catalyst beads positioned within the bed 2 are of conventional design. These catalyst pellets or beads effect oxidation or reduction of exhaust gases so that the exhaust gases reduce the amounts of harmful or irritant constituants of the exhaust gases. It is important the the catalyst pellets be packed tightly into the bed 1 and that voids be avoided to minimize abrading. However, voids are created because of the expansion of metal components when the converter is heated to temperatures of about 1500 degrees Fahrenheit and more and when the converter moves during the use of the automobile. It is preferrable to maintain the amount of voids in the bed 1 to under four percent of volume.

In the preferred embodiment, heat expansion means 25 are provided at rear end of the bed 1. These heat expansion means 25 are designed to maintain compressive pressure on the pellets and to occupy voids which otherwise would occur in the normal operation of the converter. In a preferred form of the invention, the heat expanding means 25 comprises a ceramic fiber, vermiculite and binder composition. Such a compositon of material is sold by 3M Company under the trademark INTERAM. This material is a composite blend of alumina-silica, ceramic fibers, a vermiculite and butadiene-acrylonitrile latex binder. The composition is positioned at one end of the bed 1. The function of the binder is to provide form and cohesiveness to the composition during handling. This binder, however, burns away when the composition is subjected to heat in the use of the system. The vermiculite expands with heat and occupies voids that otherwise would exist. The alumina-silica fibers function to hold the shape of the composition during high temperatures and provide integrity to the composition. In a preferred composition there is provided between 30 and 45 percent by volume of alumina-silica fibers between 45 and 60 percent by volume of the vermiculite and between 6 and 13 percent of organic fiber. In use, the heat expanding material expands to occupy the void with the vermiculite expanding under the heat and maintaining its expanded volume.

In an alternate embodiment, the heat expanding material may comprise a steel wire mesh having the consistency of steel wool but designed to withstand the temperatures to which this system is normally subjected. Such a metal mesh may comprise a high temperature steel such as Inconel.

Having now described my invention, I claim:

1. A catalytic converter comprising an annular catalyst bed containing catalyst beads and defined by coaxial inner and outer louvered tubed, an outer shell coaxial with said catalytic bed, means forming a gas flow path through said converter wherein said catalyst bed is interposed between an upstream flow portion and a downstream portion of said gas flow path with said upstream portion defined in part by the inner surface of said inner louvered tube and said downstream portion defined in part by the outer surface of said outer louvered tube and the inner surface of said outer shell, and means forming an outlet in said downstream portion having a cross-sectional area that is no greater than the cross-sectional area of said upstream portion, said outlet means comprising a flange that defines the rear wall of said catalyst bed and projects radially beyond said outer louvered tube, toward said outer sheet, and into said downstream portion, thereby constricting said flow path, said flange including a plurality of radial tabs that engage the inner surface of said shell, thereby further constricting and defining the flow path between the flange and the outer shell.

2. A catalytic converter as set forth in claim 1 wherein said outlet has a cross-sectional area that is less than a cross-sectional area of said upstream portion.

3. A catalytic converter as set forth in claim 1 wherein said catalytic bed is filled with catalyst beads and with heat expansion means therein.

4. A catalytic converter as set forth in claim 2, wherein said catalytic bed is filled with catalytic beads and with heat expansion means therein.

5. A catalytic converter as set forth in claim 3, wherein said heat expansion means is located at one end of said catalytic bed between said louvered tubes.

* * * * *